US008079401B2

(12) United States Patent
Sundarraj et al.

(10) Patent No.: US 8,079,401 B2
(45) Date of Patent: Dec. 20, 2011

(54) METHOD AND APPARATUS FOR FORMING A CASTING

(75) Inventors: Suresh Sundarraj, Bangalore (IN); Anil K. Sachdev, Rochester Hills, MI (US); Michael J. Walker, Windsor (CA)

(73) Assignee: GM Global Technology Operations LLC, Detroit, MI (US)

( * ) Notice: Subject to any disclaimer, the term of this patent is extended or adjusted under 35 U.S.C. 154(b) by 193 days.

(21) Appl. No.: 12/606,294

(22) Filed: Oct. 27, 2009

(65) Prior Publication Data

US 2011/0094701 A1 Apr. 28, 2011

(51) Int. Cl.
*B22D 15/00* (2006.01)
*B22D 27/04* (2006.01)

(52) U.S. Cl. ..... 164/127; 164/348; 164/353; 164/355; 164/356

(58) Field of Classification Search ..... 164/127, 164/348, 352–357
See application file for complete search history.

(56) References Cited

U.S. PATENT DOCUMENTS 1,817,388 A * 8/1931 Melcher ..... 164/32
* cited by examiner

*Primary Examiner* — Kuang Lin

(57) ABSTRACT

A casting chamber configured to form a casting from molten material includes an outer mold, a plurality of inner core elements, and a surface portion of a thermal chill device. The thermal chill device includes first and second interchangeable elements with the surface portion of the thermal chill device including one of a first surface portion of the first interchangeable element and a second surface portion of the second interchangeable element. The first surface portion of the first interchangeable element includes an insulating material and the second surface portion of the second interchangeable element comprising a metallic material.

16 Claims, 7 Drawing Sheets

METHOD AND APPARATUS FOR FORMING A CASTING

TECHNICAL FIELD

This disclosure is related to metal casting processes for forming a casting.

BACKGROUND

The statements in this section merely provide background information related to the present disclosure and may not constitute prior art.

Casting processes for forming articles using molds and cores employ casting chambers including outer molds and inner core elements each having features and reliefs that form details, recesses, and cavities in a casting when molten material such as liquid metal is poured into the mold. One casting formed by such a casting process is an engine block formed from molten cast iron or molten aluminum alloys. Inner core elements can be constructed from bonded sand. The inner core elements are extracted from the casting subsequent to the forming process. Portions of the casting may be subject to high-stress in-use, and it may be desirable to impart varying metallurgical properties to those portions. For example, a time-rate of removal of thermal energy from liquid metal during casting affects grain structure, with increased cooling and solidification of the poured liquid metal leading to an improvement, in general, of material properties such as tensile strength, fatigue strength, and in some cases machinability.

Known casting processes use thermal chill devices in proximity to specific portions of a casting in place of or in conjunction with features on the mold and core elements. This includes using chill devices at bulkheads and crankshaft bearing surfaces on engine blocks.

Known casting processes can include quiescently feeding molten metal upwards into a casting chamber in a counter-gravity fill process. The casting process can include subsequently inverting the casting chamber to allow molten metal to gravity-feed into the inverted casting chamber to fully form the casting.

SUMMARY

A casting chamber configured to form a casting from molten material includes an outer mold, a plurality of inner core elements, and a surface portion of a thermal chill device. The thermal chill device includes first and second interchangeable elements with the surface portion of the thermal chill device including one of a first surface portion of the first interchangeable element and a second surface portion of the second interchangeable element. The first surface portion of the first interchangeable element includes an insulating material and the second surface portion of the second interchangeable element comprising a metallic material.

BRIEF DESCRIPTION OF THE DRAWINGS

One or more embodiments will now be described, by way of example, with reference to the accompanying drawings, in which.

DETAILED DESCRIPTION

Figure 1:
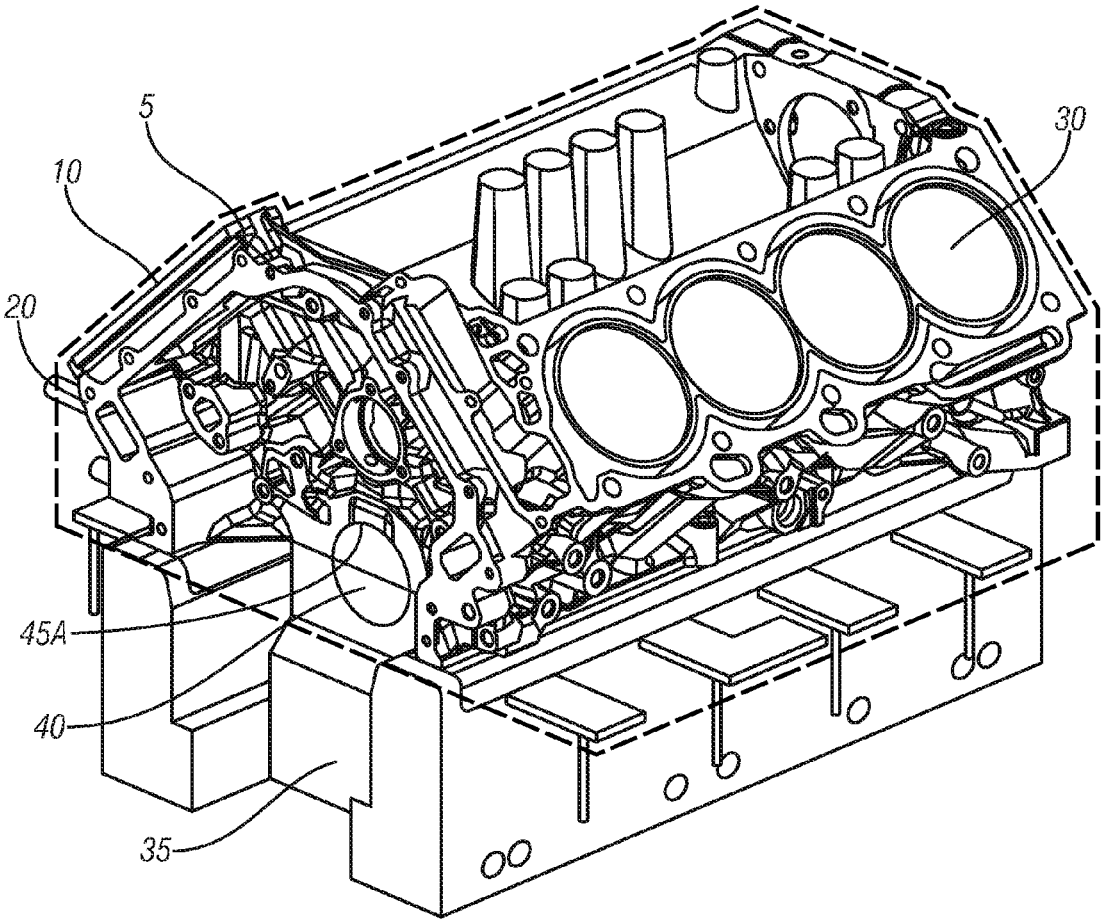
FIG. 1 is a three-dimensional schematic diagram of a casting system in accordance with the present disclosure.

Referring now to the drawings, wherein the showings are for the purpose of illustrating certain exemplary embodiments only and not for the purpose of limiting the same, FIG. 1 schematically illustrates a casting chamber 10 for producing a casting 5, in one embodiment including an engine block for an internal combustion engine. Like numerals refer to like elements throughout the embodiments.

The casting chamber 10 is formed using an outer mold 20, an inner core element 30, and a first outer surface portion 45A of a rotatable thermal chill device 40 of a thermal chill assembly 35. In one embodiment the inner core element 30 is a sand core element formed from silica sand mixed with a polyurethane binding material and formed into an appropriate shape associated with the casting. Inner surfaces of the outer mold 20 and the inner core element 30 and the outer surface portion 45A of the rotatable thermal chill device 40 define the casting chamber 10 for producing the casting 5.

The casting process includes forming the casting 5 in the casting chamber 10 by feeding molten material into the casting chamber 10 which subsequently solidifies as it cools below its solidification temperature. In one embodiment, the molten material feeds into the casting chamber 10 in a counter-gravity fill process. The casting 5 is depicted as an engine block for an internal combustion engine. A skilled practitioner can apply the principles described herein to form a multiplicity of other castings. In one embodiment the molten or liquid material is an aluminum alloy.

Figure 2:
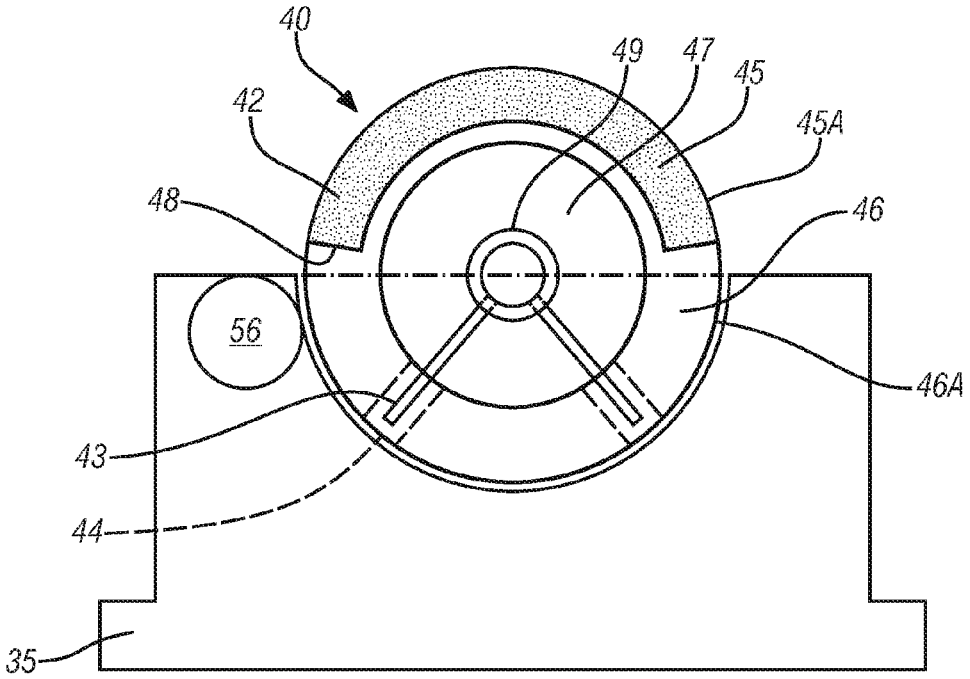
FIG. 2 is a two-dimensional schematic diagram of a thermal chill assembly for a casting system in accordance with the present disclosure.

FIG. 2 shows a two-dimensional schematic diagram depicting a cross-sectional view of an embodiment of the thermal chill assembly 35 including a rotatable thermal chill device 40. The rotatable thermal chill device 40 includes a first element 45 and a second element 46, including the first outer surface portion 45A and a second outer surface portion 46A, respectively. The first outer surface portion 45A and the second outer surface portion 46A preferably have identical geometric shapes. The first outer surface portion 45A and the second outer surface portion 46A are preferably interchangeable with regard to forming and defining the casting chamber 10. The rotatable thermal chill device 40 as shown is a device having an annular cross-section that includes first and second opposed semi-cylindrical surface elements that form the first and second outer surface portions 45A and 46A and an inner surface forming an inner chamber 47 within the rotatable thermal chill device 40.

In one embodiment, the first outer surface portion 45A is formed from high-temperature insulating material 42 and is configured to contact the casting 5 during a first period or step in the casting process. The second outer surface portion 46A is constructed from metal and is configured to contact the casting 5 during a second subsequent period or step in the casting process.

As shown, the rotatable thermal chill device 40 includes a cylindrically shaped metallic element having an annular cross-section. A recess 48 is cut into the semi-cylindrical element of the first element 45 coincident with the first outer surface portion 45A. The recess 48 is laminated with high-temperature insulating material 42 that is preferably cured in place such that the first outer surface portion 45A has a cross-sectional form that is geometrically identical to the second outer surface portion 46A, with both being semi-cylindrical surfaces in this embodiment. The insulating material 42 is constructed from insulating or refractory material that is mounted to the recess 48 by one of an adhesive or metal glue and mechanical fixturing, or can be cast in place. The insulator material can include alumina, magnesia, silica, silicon carbide, or a combination thereof, or bonded sand similar to that used in making a sand core. Alternatively, the first outer surface portion 45A is a unitary piece formed completely from the insulating material and having a cross-sectional form that is geometrically identical to the second outer surface portion 46A. An embodiment depicting the first outer surface portion 45A as a unitary piece is shown with reference to FIG. 3.

The rotatable thermal chill device 40 includes a plurality of radial pass-through holes 44 located along a longitudinal axis that pass through the second outer surface portion 46A of the second semi-cylindrical surface element 46. Each of the pass-through holes 44 provides a fluidic flow passageway between the inner chamber 47 and the second outer surface portion 46A of the second element 46. A fluid dispensing mechanism 49 including a fluidic pipe fluidly connected to a plurality of radial jets 43 is inserted into the inner chamber 47 and is configured to inject a cooling fluid to contact a portion of a surface of the casting 5 contiguous to the second outer surface portion 46A of the rotatable thermal chill device 40. The radial jets 43 pass through a portion of the radial pass-through holes 44 and have openings on distal ends thereof. Cooling fluid injected through the radial jets 43 contacts the surface of the casting 5 contiguous to the second outer surface portion 46A to effect cooling thereof, and flows through the radial pass-through holes 44 to the inner chamber 47 for removal, e.g., via a vacuum system. Injecting the cooling fluid through the radial jets 43 and subsequent evacuation of steam is timed to achieve a maximum cooling benefit with acceptable amount of steam generation.

The fluid dispensing mechanism 49 is an element of a cooling fluid dispensing system that is housed in the thermal chill assembly 35 in one embodiment. The fluid dispensing system includes a pump mechanism that is configured to pump cooling fluid, e.g., water to the fluid dispensing mechanism 49.

The rotatable thermal chill device 40 is mounted on the thermal chill assembly 35. In one embodiment a portion of the thermal chill device extends longitudinally outside the thermal chill assembly 35 and contacts a rotating mechanism 56 for rotating the rotatable thermal chill device 40 about its longitudinal axis between a first position and a second position. When the thermal chill device 40 is in the first position (as shown), the first outer surface portion 45A forms and defines the casting chamber 10, preferably during the portion of the casting process when molten material is flowing into the casting chamber 10. The casting process preferably includes rotating the rotatable thermal chill device 40 to the second position, with the second outer surface portion 46A forming and defining the casting chamber 10. The rotating mechanism 56 rotates the rotatable thermal chill device 40 about the longitudinal axis between the first and second positions, preferably rotating to the second position subsequent to the portion of the casting process when molten material is flowing into the casting chamber 10.

Figure 3:
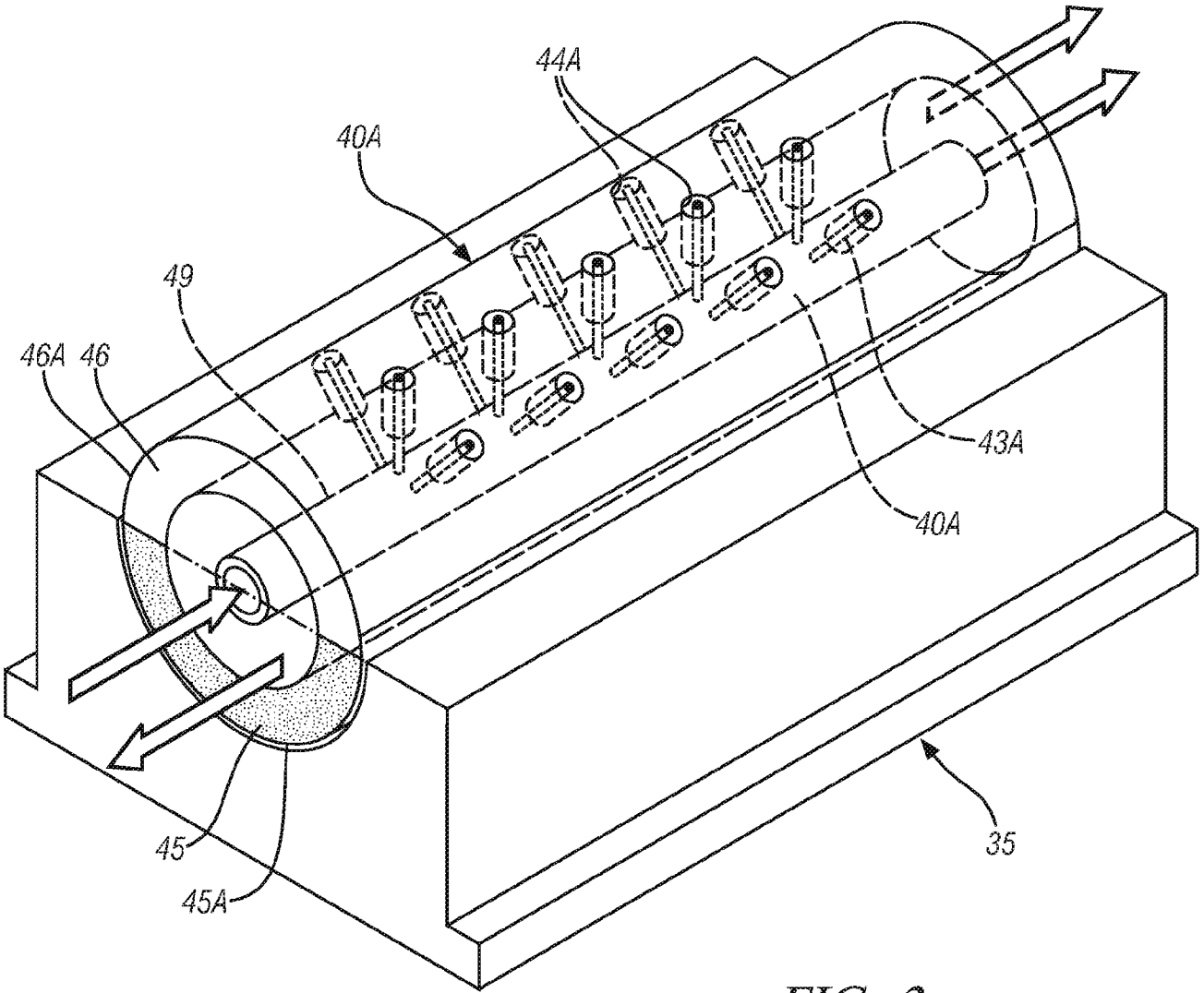
FIGS. 3-7 are three-dimensional schematic diagrams of embodiments of a thermal chill assembly for a casting system in accordance with the present disclosure.

FIG. 3 schematically shows a three-dimensional perspective of an embodiment of rotatable thermal chill device 40A, wherein the rotatable thermal chill device 40A is cylindrically shaped. In this embodiment, the first element 45 and the second element 46 are unitary pieces formed completely from homologous materials. The first element 45 is formed entirely from insulating material and the second element 46 is formed entirely from a metal, e.g., H13 steel. The first element 45 and the second element 46 each have cross-sectional forms that are geometrically identical. Radial jets 43A pass through a portion of radial pass-through holes 44A and have openings on distal ends thereof.

During the casting process, the first outer surface portion 45A forms and defines the casting chamber 10 during the portion of the casting process when molten material is flowing into the casting chamber 10. The casting process preferably includes rotating the rotatable thermal chill device 40A to the second position, with the second outer surface portion 46A forming and defining the casting chamber 10. The rotating mechanism 56 rotates the rotatable thermal chill device 40A about the longitudinal axis between the first and second positions, preferably rotating to the second position subsequent to the portion of the casting process when molten material is flowing into the casting chamber 10. Cooling fluid injected through the radial jets 43A contacts the surface of the casting 5 contiguous to the second outer surface portion 46A to effect cooling thereof, during which time the cooling fluid vaporizes. The vaporized cooling fluid passes through the radial pass-through holes to the inner chamber 47 for removal, e.g., via a vacuum system.

Figure 4:
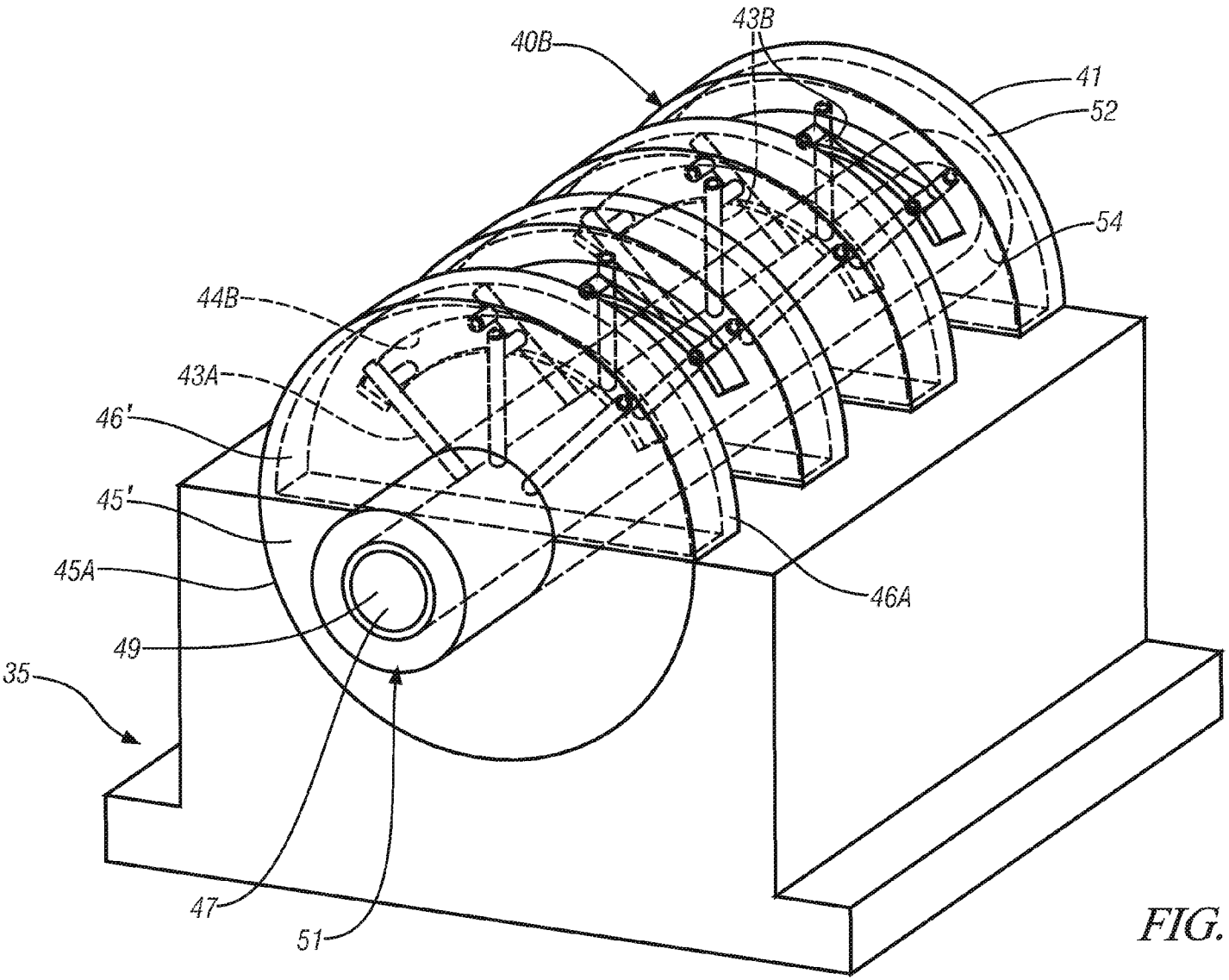
Figure 5:
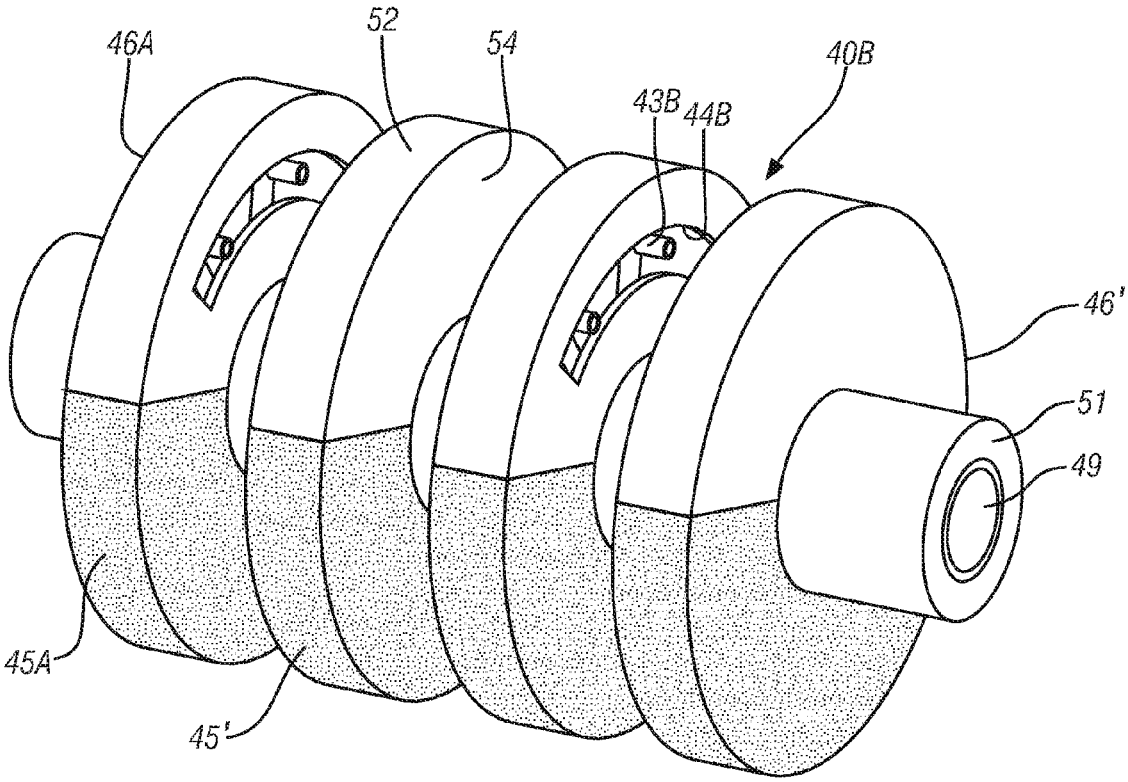

FIGS. 4 and 5 schematically show three-dimensional drawings of another embodiment of the thermal chill assembly 35' including rotatable thermal chill device 40B. The rotatable thermal chill device 40B includes a plurality of coaxial disks 41 that are each cylindrically shaped and are fixedly connected on a cylindrical shaft 51 that contains the fluid dispensing mechanism 49. In one application, the rotatable thermal chill device 40B and the coaxial disks 41 conform to a bulk head shape associated with an engine block. The rotatable thermal chill device 40B includes a first element 45' and a second element 46' that are first and second semi-circular portions of the coaxial disks 41, respectively. The first element 45' includes outer surface portions including circumferential surface portions and side surface portions. The second element 46' includes an outer surface portion including a circumferential surface portion 52 and a side surface portion 54.

In this embodiment, the first element 45' and the second element 46' are preferably unitary semicircular portions of the coaxial disks 41 formed completely from homologous materials. The first element 45' is formed from the insulating material and the second element 46' is formed from a metal, e.g., H13 steel. The first element 45' and the second element 46' have cross-sectional forms that are geometrically identical. Each of the second elements 46' includes radial pass through holes terminating at an annular opening 44B on one or both the side surface portions 54 of the outer surface. Radial jets 43B pass through radial holes in the second element 46' and terminate at a radial distance that is less than an outside radius of each coaxial disk 41 and coincident with the associated annular opening 44B. Each of the radial jets 43B has one or more fluidic openings that are orthogonal to the radial axis and preferably parallel to the longitudinal axis of the rotatable thermal chill device 40.

During the casting process, the outer surface portions of the first element 45' form and define the casting chamber 10 during the portion of the casting process when molten material is flowing into the casting chamber 10. The casting process preferably includes rotating the rotatable thermal chill device 40B to the second position, with the circumferential surface portion 52 and the side surface portion 54 forming and defining the casting chamber 10. The rotating mechanism 56 rotates the rotatable thermal chill device 40B about the longitudinal axis from the first to the second position, preferably rotating to the second position subsequent to the portion of the casting process when molten material is flowing into the casting chamber 10. Cooling fluid injected through the radial jets 43B contacts the surface of the casting 5 contiguous to the annular openings 44B in the side surface portion 54 to effect cooling thereof, and flows through the radial pass-through holes 44A to the inner chamber 47 for removal, e.g., via a vacuum system.

Figure 6:
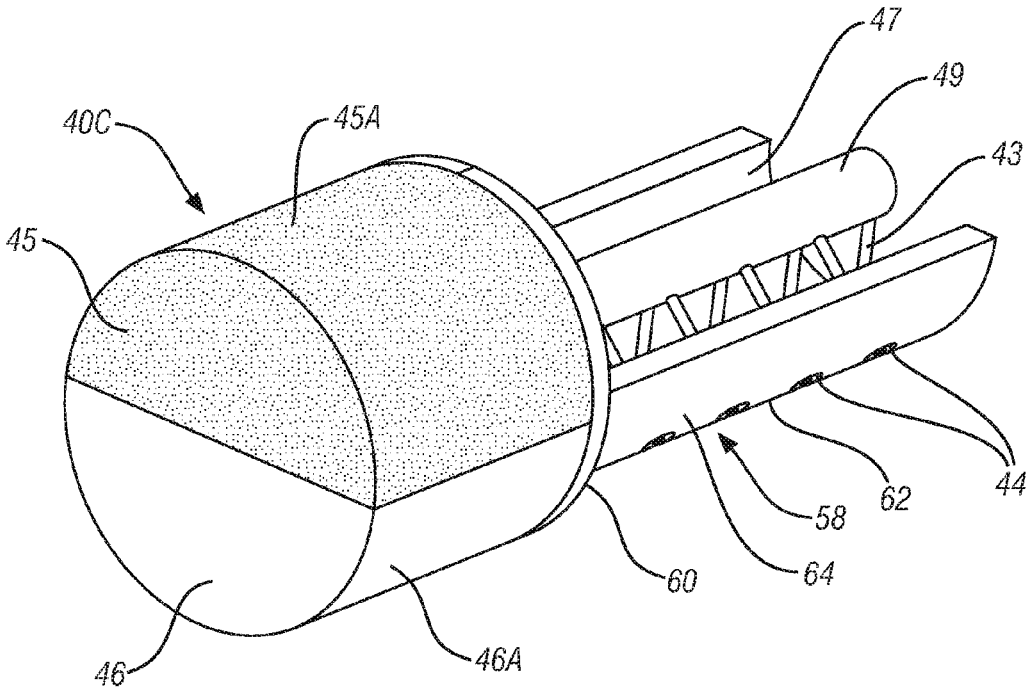

FIG. 6 schematically shows a three-dimensional drawing of another embodiment of a rotatable thermal chill device 40C. The rotatable thermal chill device 40C of this embodiment includes the first element 45 and the second element 46 including the first outer surface portion 45A and the second outer surface portion 46A, respectively. The first outer surface portion 45A and the second outer surface portion 46A preferably have identical geometric shapes. The first outer surface portion 45A and the second outer surface portion 46A are preferably interchangeable with regard to forming and defining the casting chamber 10. The rotatable thermal chill device 40C as shown has a circular cross-section that includes first and second opposed semi-cylindrical surface elements that form the first and second outer surface portions 45A and 46A. The rotatable thermal chill device 40C includes a cooling section 58 that is collinear to a longitudinal axis of the first and second opposed semi-cylindrical surface elements that form the first and second outer surface portions 45A and 46A, and attached thereto with a separator 60. The cooling section 58 includes a cylindrical element 62 including an outer surface portion 64 having a radius that is preferably less than the radii associated with the first and second outer surface portions 45A and 46A, and includes inner chamber 47. The cylindrical element 62 includes a plurality of pass-through holes 44 located along a longitudinal axis that pass through the outer surface portion 64 and provide a fluidic flow passageway between the inner chamber 47 and the outer surface portion 64. The fluid dispensing mechanism 49 includes a fluidic pipe fluidly connected to a plurality of radial jets 43 is inserted into the inner chamber 47 and is configured to inject a cooling fluid to contact a portion of a surface of the casting 5 contiguous to the outer surface portion 64. The radial jets 43 pass through a portion of the radial pass-through holes 44 and have openings on distal ends thereof.

During an initial portion of the casting process, the casting chamber 10 includes the outer mold 20, the inner core element 30, and the first outer surface portion 45A of the rotatable thermal chill device 40C. Subsequently, the rotatable thermal chill device 40C is rotated, and the casting chamber 10 includes the outer mold 20, the inner core element 30, and the second outer surface portion 46A. After a skin has formed on the casting 5, the rotatable thermal chill device 40C is translated linearly to expose a portion of the casting 5 to the cooling section 58. Cooling fluid injected through the radial jets 43 contacts the surface of the casting 5 contiguous to the cooling section 58 to effect cooling thereof, and flows through the radial pass-through holes 44 to the inner chamber 47 for removal, e.g., via a vacuum system. Injecting the cooling fluid through the radial jets 43 and subsequent evacuation of steam is timed to achieve a maximum cooling benefit with acceptable amount of steam generation.

Figure 7:
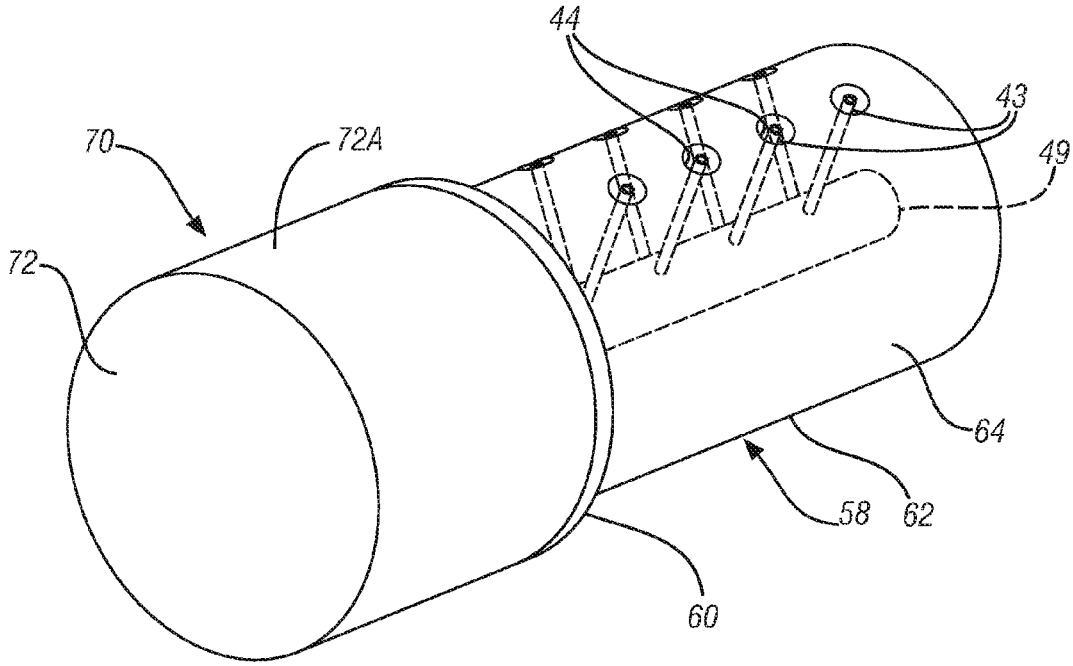

FIG. 7 schematically shows a three-dimensional drawing of an embodiment of a thermal chill device 70. The thermal chill device 70 of this embodiment includes a first element 72 including a first outer surface portion 72A, and cooling section 58. The thermal chill device 70 as shown is a cylindrically shaped device including the first outer surface portion 72A that forms and defines the casting chamber 10. The cooling section 58 coaxial to the first element 72 and attached thereto with separator 60. The cooling section 58 includes the cylindrical element 62 including outer surface portion 64 having a radius that is preferably less than the radius associated with the first element 72, and includes the inner chamber 47. The cylindrical element 62 includes a plurality of pass-through holes 44 located along a longitudinal axis that pass through the outer surface portion 64 and provide a fluidic flow passageway between the inner chamber 47 and the outer surface portion 64. The fluid dispensing mechanism 49 includes a fluidic pipe fluidly connected to a plurality of radial jets 43 is inserted into the inner chamber 47 and is configured to inject a cooling fluid to contact a portion of a surface of the casting 5 contiguous to the outer surface portion 64. The radial jets 43 pass through a portion of the radial pass-through holes 44 and have openings on distal ends thereof.

During an initial portion of the casting process, the casting chamber 10 includes the outer mold 20, the inner core element 30, and the first element 72 of the thermal chill device 70. After a skin has formed on the casting 5, the thermal chill device 70 is translated linearly to expose a portion of the casting 5 to the cooling section 58. Cooling fluid injected through the radial jets 43 contacts the surface of the casting 5 contiguous to the cooling section 58 to effect cooling thereof, and flows through the radial pass-through holes 44 to the inner chamber 47 for removal, e.g., via a vacuum system. Injecting the cooling fluid through the radial jets 43 and subsequent evacuation of steam is timed to achieve a maximum cooling benefit with acceptable amount of steam generation.

Figure 8A:
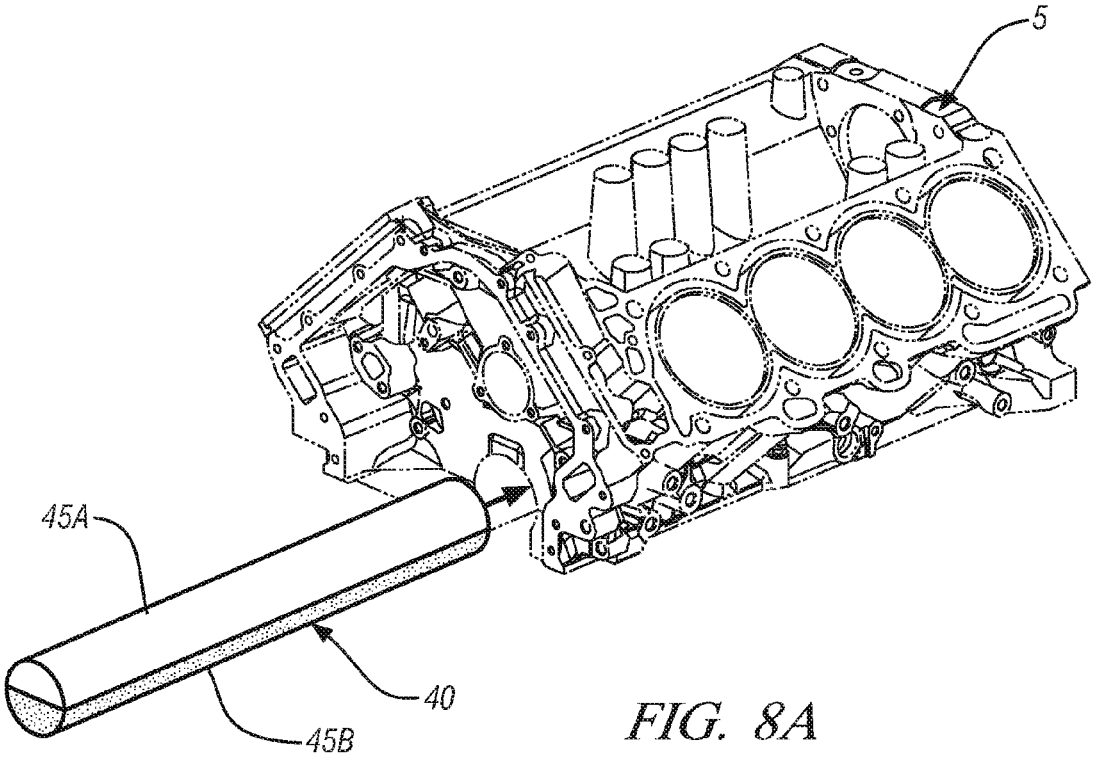
FIGS. 8A-8D are three-dimensional schematic diagrams exemplifying a method associated with a casting system in accordance with the present disclosure.
Figure 8B:
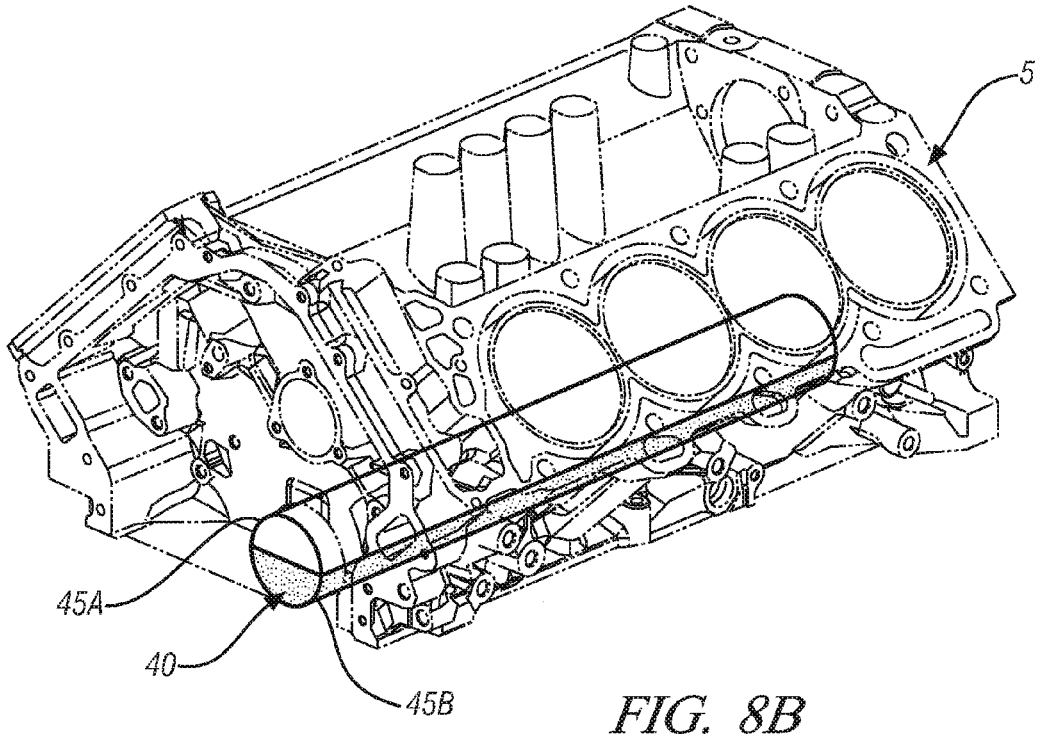
Figure 8C:
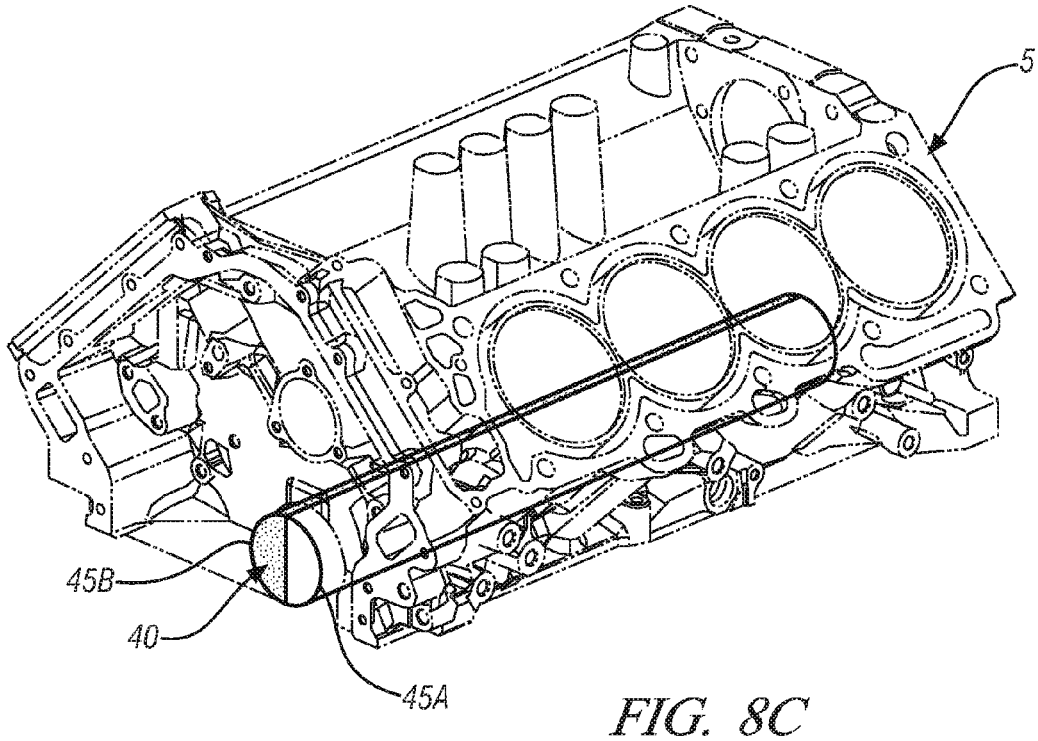
Figure 8D:
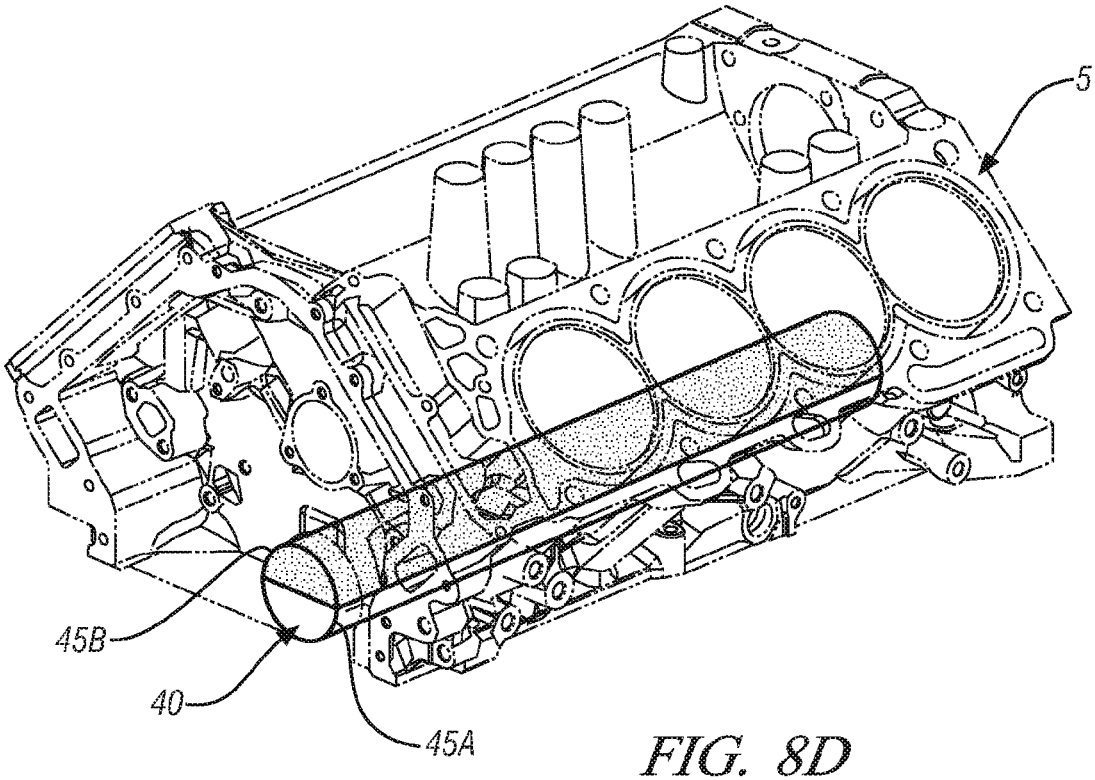

FIGS. 8A-8D schematically depict an exemplary casting process associated with using the thermal chill device 40 described hereinabove. FIG. 8A shows assembling the casting chamber 10 using the outer mold 20 and the inner core element 30 with the thermal chill device 40 being inserted therein. FIG. 8B shows the assembled casting chamber 10 having the outer mold 20 and the inner core element 30 with the thermal chill device 40 inserted such that the first outer surface portion 45A formed from the high-temperature insulating material 42 forms part of the casting chamber 10. Molten metal is pumped into the casting chamber 10 at a lower entrance point as part of the counter-gravity fill process. The molten metal comes into physical contact with the casting chamber 10 including the first outer surface portion 45A. There is limited heat transfer from the molten metal through the high-temperature insulating material that forms the first outer surface portion 45A, thus limiting solidification of the molten metal during the period of time when the casting chamber 10 is being filled. FIG. 8C shows the thermal chill device 40 rotating about its longitudinal axis from the first position to the second position, allowing the metallic surface of the second outer surface portion 46A to come into contact with the casting being formed. FIG. 8D shows the assembled casting chamber 10 having the outer mold 20 and the inner core element 30 with the thermal chill device 40 inserted such that the second outer surface portion 46A formed from steel forms part of the casting chamber 10. Subsequently, a cooling fluid dispensing system dispenses cooling fluid into the inner chamber 47 via the fluid dispensing mechanism 49. When dispensed, the cooling fluid passes through the plurality of radial pass-through holes 44 and contacts the casting to assist in forming a stable skin on the surface of the casting and accelerate solidification thereof. The solidification of the casting is directional, originating from the portion of the casting in proximity to the thermal chill device 40.

Subsequent to extracting the thermal chill device 40 from the casting, the casting can be subjected to a spray cooling or misting process, wherein cooling fluid, e.g., water, is sprayed directly onto the casting at the location previously occupied by the thermal chill device 40 to further accelerate cooling thereof. This process also increases rate of solidification of the casting in the portion nearest the location of the thermal chill device 40, thus enhancing quality of the casting due to a refined metallurgical microstructure thereat.

The process described with reference to FIGS. 8A-8D can reduce cycle time in manufacturing a casting, e.g., an engine block casting, by managing heat transfer from the casting through the thermal chill device 40. This includes initially minimizing heat transfer from the casting through the thermal chill device 40 during the counter-gravity fill process using the first outer surface portion 45A. Subsequently the heat transfer from the casting through the thermal chill device 40 is accelerated by exposing the casting to the second outer surface portion 46A. The heat transfer can be further accelerated by direct water spraying at appropriate locations during the solidification process. This process can reduce cycle time of casting operations. This process allows the thermal chill devices 40 to be removed and recycled into the casting process more quickly than known devices, thus reducing a required in-plant inventory for thermal chill devices 40. Presently, known thermal chill devices are only recycled after the casting has cooled sufficiently to permit extraction therefrom.

Figure 9:
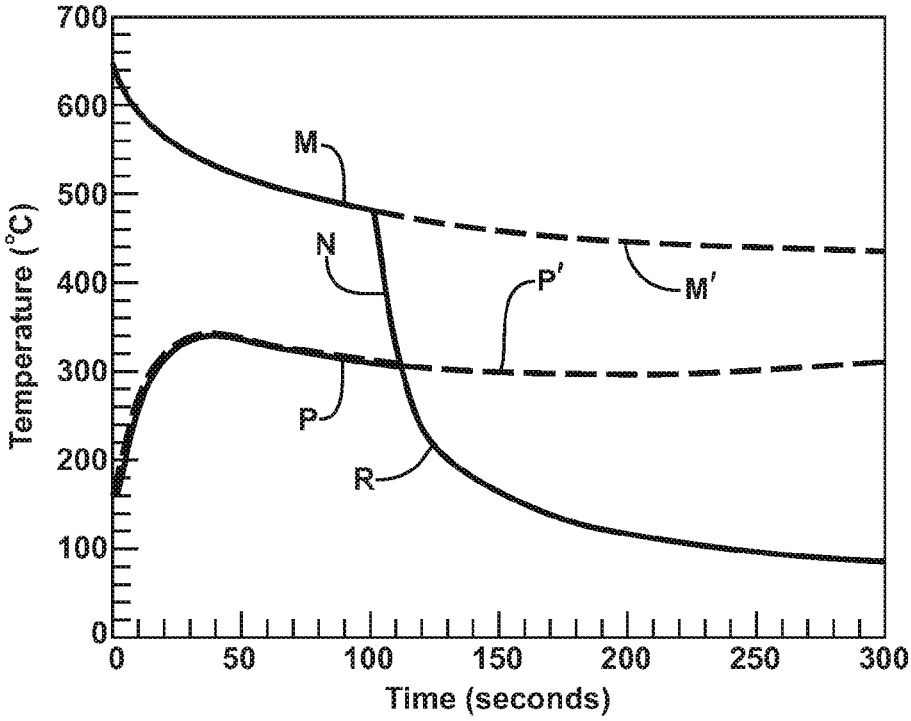
FIG. 9 is a datagraph in accordance with the present disclosure.

FIG. 9 graphically shows simulated temperatures including a casting temperature as a function of elapsed time during a casting process for an exemplary system using a rotatable thermal chill device as described hereinabove. The casting temperature is simulated at a location 5 mm below a surface on the thermal chill device at an interface between the rotatable thermal chill device and the casting during the casting process. Line M and M' depict a casting temperature associated with cooling a casting in a known system with a known all-steel chill device. Line N depicts a casting temperature associated with cooling a casting in a known system, with the known all-steel chill device removed after 100 seconds and having water sprayed directly onto the casting at the location previously occupied by the known all-steel thermal chill device. Line P and P' depicts a temperature of the second outer surface portion of the rotatable thermal chill device associated with cooling a casting, with the rotatable thermal chill device being rotated at time 0 seconds from the first outer surface portion to the second outer surface portion. Line R depicts temperatures of the second outer surface portion associated with cooling the casting with the rotatable thermal chill device removed after 100 seconds with water sprayed directly onto the casting. These results indicate that using the rotatable thermal chill device in conjunction with water sprayed directly onto the casting can reduce substantially temperatures of the casting and the thermal chill device.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A casting chamber configured to form a casting from molten material, comprising:

an outer mold, a plurality of inner core elements, and a surface portion of a thermal chill device;

the thermal chill device including first and second position mutually interchangeable elements and the surface portion of the thermal chill device comprising one of a first surface portion of the first interchangeable element and a second surface portion of the second interchangeable element;

a mechanism for changing position of said elements after filling of said molten material;

the first surface portion of the first interchangeable element comprising an insulating material; and the second surface portion of the second interchangeable element comprising a metallic material.

2. The casting chamber of claim 1, wherein the first surface portion of the first interchangeable element has a geometric shape identical to the second surface portion of the second interchangeable element.

3. The casting chamber of claim 1, wherein the second interchangeable element of the thermal chill device further comprises an annular element including a plurality of pass-through holes providing passageways between an inner chamber and the second surface portion.

4. The casting chamber of claim 3, further comprising a fluid dispensing mechanism including a fluidic pipe fluidly connected to a plurality of jets inserted into the inner chamber, the plurality of jets configured to inject a cooling fluid that contacts a portion of a surface of the casting contiguous to the second surface portion.

5. The casting chamber of claim 1, wherein the first and second interchangeable elements comprise first and second opposed semi-cylindrical elements.

6. The casting chamber of claim 5, wherein the thermal chill device comprises a cylindrically shaped element having an annular cross-section including an outer surface comprising the first and second opposed semi-cylindrical elements.

7. The casting chamber of claim 1, wherein the thermal chill device comprises a cylindrically shaped element configured to rotate about a longitudinal axis to one of a first position and a second position; wherein the casting chamber comprises the outer mold, the inner core elements, and the first surface portion of the thermal chill device when the thermal chill device is in the first position and the casting chamber comprises the outer mold, the inner core elements, and the second surface portion of the thermal chill device when the thermal chill device is in the second position.

8. The casting chamber of claim 1, wherein:

the thermal chill device further comprises a cylindrically shaped element having an annular cross-section;

the first and second interchangeable elements comprise first and second opposed semi-cylindrical elements of the cylindrically shaped element;

the first and second opposed semi-cylindrical elements each include an outer surface;

the outer surface of the first opposed semi-cylindrical element comprises the insulating material; and the outer surface of the second opposed semi-cylindrical element comprises the metallic material.

9. The casting chamber of claim 7, wherein the first surface portion of the first interchangeable element comprising an insulating material comprises said insulating material laminated with a metallic material.

10. The casting chamber of claim 8, further comprising a fluid dispensing mechanism configured to inject cooling fluid through the outer surface of the second opposed semi-cylindrical element of the thermal chill device.

11. The casting chamber of claim 1, wherein the thermal chill device including first and second interchangeable elements comprises a plurality of coaxial disks fixedly connected on a cylindrical shaft, wherein the first interchangeable element comprises first semicircular elements of the coaxial disks formed from the insulating material and the second interchangeable element comprises second semicircular elements of the coaxial disks formed from a metal.

12. A method for forming a casting in a casting chamber including an outer mold, an inner core element, and a thermal chill device, comprising:

configuring the thermal chill device to include a first surface portion and a second surface portion, the first surface portion having a geometric shape identical to the second surface portion, the first surface portion of the thermal chill device comprising insulating material and the second surface portion comprising metallic material;

arranging the casting chamber in a pre-fill arrangement to include the outer mold, the inner core element, and the first surface portion of the thermal chill device;

filling molten material into the casting chamber in the pre-fill arrangement to form the casting; and arranging the casting chamber in a post-fill arrangement to include the outer mold, the inner core element, and the second surface portion of the thermal chill device.

13. The method of claim 12, further comprising spraying cooling fluid onto a portion of the casting contiguous to the second surface portion of the thermal chill device subsequent to arranging the casting chamber to the post-fill arrangement.

14. The method of claim 12, further comprising removing the second surface portion of the thermal chill device subsequent to the post-fill arrangement, and spraying a cooling fluid onto a portion of the casting exposed by the removing of the second surface portion of the thermal chill device.

15. The method of claim 12, wherein filling molten material into the casting chamber comprises a counter-gravity flow .

16. The method of claim 12, wherein arranging the casting chamber to the post-fill arrangement comprises rotating the thermal chill device from a first position to a second position.

* * * * *